US005386274A

United States Patent [19]

Sanpe et al.

[11] Patent Number: 5,386,274

[45] Date of Patent: Jan. 31, 1995

[54] IMAGE FORMING APPARATUS HAVING A TONER COLLECTING MECHANISM FOR REMOVING FOREIGN PARTICLES FROM THE COPIER ENVIRONMENT

[75] Inventors: Atsushi Sanpe, Yokohama; Naomi Misago, Tokyo, both of Japan

[73] Assignee: Ricoh Company, Ltd., Tokyo, Japan

[21] Appl. No.: 125,306

[22] Filed: Sep. 23, 1993

[30] Foreign Application Priority Data

| | | | |
|---|---|---|---|
| Sep. 28, 1992 | [JP] | Japan | 4-257766 |
| Nov. 19, 1992 | [JP] | Japan | 4-310066 |
| Jun. 21, 1993 | [JP] | Japan | 5-148747 |

[51] Int. Cl.[6] ..... G03G 21/00; G03G 15/16

[52] U.S. Cl. ..... 355/215; 355/274; 355/298

[58] Field of Search ..... 355/215, 271, 274, 278

[56] References Cited

U.S. PATENT DOCUMENTS

| | | | |
|---|---|---|---|
| 3,832,053 | 8/1974 | Goel et al. | 355/274 |
| 4,260,243 | 4/1981 | Dolan et al. | 355/298 X |
| 4,376,578 | 3/1983 | Tanaka et al. | 355/274 X |
| 4,387,982 | 6/1983 | Stanley | 355/215 |
| 4,396,273 | 8/1983 | Matsuyama et al. | 355/274 |
| 4,819,026 | 4/1989 | Lange et al. | 355/298 |
| 4,912,516 | 3/1990 | Kaieda | 355/274 |
| 5,028,959 | 7/1991 | Gooray | 355/215 |
| 5,153,642 | 10/1992 | Folkins et al. | 355/215 |
| 5,182,605 | 1/1993 | Yamada et al. | 355/274 |
| 5,253,022 | 10/1993 | Takeuchi et al. | 355/274 |

*Primary Examiner*—Fred L. Braun

*Attorney, Agent, or Firm*—Oblon, Spivak, McClelland, Maier & Neustadt

[57] ABSTRACT

An electrophotographic image forming apparatus capable of collecting a toner remaining on a photoconductive element after image transfer. A developing device develops a latent image electrostatically formed on the surface of a photoconductive element. A paper and paper dust, paper fibers and other impurities produced from the paper before, after and during image transfer are caused to electrostatically adhere to a transfer belt included in a contact type transferring device. After the developed image has been transferred to the paper, a cleaning device associated with the photoconductive element removes a toner remaining thereon. The tone so collected by the cleaning device is conveyed to the developing device by a transporting device. Impurities deposited on the transfer belt are not conveyed to the developing device. An arrangement of a bias roller having a transfer bias from a high-tension power source and a contact plate located downstream of the bias roller ensure not only that the impurities remain on the transfer belt but also reduce reverse charging during image transfer with the result that most of the residual toner reaches the drum cleaning device while preserving the original polarity thereof.

3 Claims, 5 Drawing Sheets

IMAGE FORMING APPARATUS HAVING A TONER COLLECTING MECHANISM FOR REMOVING FOREIGN PARTICLES FROM THE COPIER ENVIRONMENT

BACKGROUND OF THE INVENTION

The present invention relates to a copier, printer, facsimile machine or similar electrophotographic image forming apparatus and, more particularly, to an image forming apparatus having a mechanism for collecting a toner left on a photoconductive element after image transfer.

An image forming apparatus of the type described usually includes a photoconductive element implemented as a drum. Arranged around the drum are a device for electrostatically forming a latent image on the drum, a device for developing the latent image, a device for transferring the developed image, or toner image, from the drum to a paper, a device for cleaning the drum, i.e., removing a toner remaining on the drum, a device for conveying the toner removed by the cleaning device to the developing device, a device for feeding a paper to the transferring device via a registration roller, and a fixing device. The paper reached the registration roller is driven toward the drum at a predetermined timing in synchronism with the rotation of the drum. As the leading edge of the paper abuts against the drum, the drum causes it to electrostatically adhere thereto and transports it. At this instant, the paper closely adheres to the drum due to the elasticity thereof and an electrostatic force. In this condition, the transferring device transfers a toner image from the drum to the paper.

An image forming apparatus of the type using a recording body implemented by an endless dielectric film or belt is disclosed in Japanese Patent Laid-Open Publication (Kokai) No. 179879/1982 by way of example. This type of apparatus locates recording electrodes between the opposite runs of the belt and disposes a developing device using a magnetic toner outside of the belt. A voltage is selectively applied to the recording electrodes to form a toner image on the belt. The toner image is transferred from the belt to a paper. After the image transfer, the charge of the toner left on the belt is dissipated. Subsequently, the toner deposited on the belt is magnetically removed by and collected in the developing device.

The problem with an image forming apparatus of any of the above-described types is impurities which include paper dust produced when a paper is cut, paper fibers produced when a paper is perforated or punched, and talc, resin and other components of a paper. Such impurities are produced in a great amount when, among others, a great number of papers are used or when papers of the kind producing a great amount of paper dust are used. The impurities electrostatically adhere to the surface of the photoconductive element in the event of image transfer. Further, when the trailing edge of a paper shakes at the end of image transfer, paper dust produced from the cut edge of the paper deposits on the background of the photoconductive element. In this condition, when the cleaning device removes the toner remaining on the photoconductive element, the paper dust and other impurities stop the gap between the element and the edge of a cleaning blade, thereby degrading the cleaning ability. Moreover, when the collected toner is returned to the developing device, the impurities are apt to deposit, grow and then collapse on the inner periphery of the casing of the developing device. This part of the toner is caught by a doctor included in the developing device, resulting in defective images. Further, the collected toner contains, in addition to the impurities, a toner of relatively small particle size, a toner pulverized during the course of development or image transfer, and a toner whose chargeability is different from the chargeability of the toner to be supplied. When such a composite toner is returned to the developing device, the pulverized toner coheres on the impurities, or cores, and lowers the image quality.

In the light of the above, a mesh may be disposed in a path along which the collected toner is transported to the developing device, as proposed in the past. This kind of scheme, however, needs vibrating means, a replacing mechanism, cleaning means, a slide mechanism and so forth to prevent the mesh from being stopped up, complicating the overall structure of the apparatus. In addition, the mesh scheme lowers the reliability of the apparatus by bringing about toner scattering, toner blocking and other undesirable occurrences. Alternatively, use may be made of an electric field or a pneumatic pressure. Further, a device capable of removing paper dust from a paper before image transfer may be used, as disclosed in Japanese Patent Laid-Open Publication No. 55128/1978. However, even such alternative schemes complicate the overall structure of the apparatus, increase the size and cost of the apparatus, and need a broad area for installation.

SUMMARY OF THE INVENTION

It is, therefore, an object of the present invention to provide an image forming apparatus having a toner collecting mechanism which eliminates the problems discussed above.

It is another object of the present invention to provide an image forming apparatus capable of collecting impurities without resorting to an exclusive device.

It is a further object of the present invention to provide an image forming apparatus which is simple and miniature in construction and saves space and cost.

An image forming apparatus capable of collecting a toner remaining on a photoconductive element of the present invention comprises a latent image forming device for electrostatically forming a latent image on the photoconductive element, a developing device for developing the latent image to produce a corresponding toner image, a transferring device for transferring the toner image to a paper, a cleaning device for collecting the toner remaining on the photoconductive element after image transfer, and a transporting device for transporting the toner collected by the cleaning device to the developing device. The transferring device comprises a contact type transferring device having a transfer belt which transports the paper by causing it to electrostatically adhering thereto.

BRIEF DESCRIPTION OF THE DRAWINGS

The above and other objects, features and advantages of the present invention will become more apparent form the following detailed description taken with the accompanying drawings in which.

DESCRIPTION OF THE PREFERRED EMBODIMENTS

Figure 7:
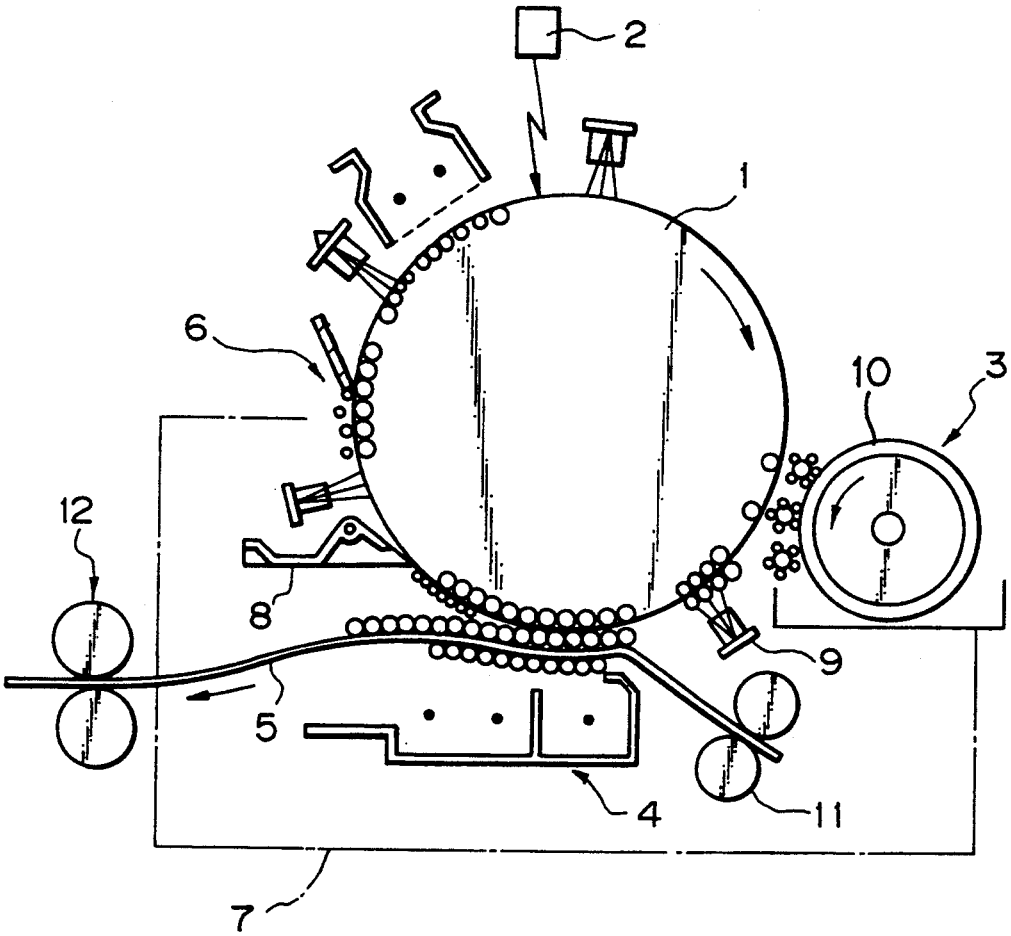
Fig. 7 PRIOR ART
FIG. 7 is a section of a conventional image forming apparatus.

To better understand the present invention, a brief reference will be made to a conventional image forming apparatus, shown in FIG. 7. As shown, the image forming apparatus has a photoconductive element in the form of a drum 1. Arranged around the drum 1 are a device 2 for electrostatically forming a latent image on the drum 1, a device 3 for developing the latent image, a device 4 for transferring the developed image, or toner image, from the drum 1 to a paper 5, a device 6 for cleaning the drum 1, i.e., removing a toner remaining on the drum 1, and a device 7 for conveying the toner removed by the device 6 to the device 3. There are also shown in the figure a fixing device 12 for fixing the toner image on the paper 5, a separator 8 for separating the paper 5 from the drum 1 a pretransfer discharge lamp 9, a developing roller 10, and a registration roller 11. The paper 5 reached the registration roller 11 is driven toward the drum 1 at a predetermined timing in synchronism with the rotation of the drum 1. As the leading edge of the paper 5 abuts against the drum 1, the paper 5 is caused to electrostatically adhere to the drum 1 and transported by the drum 1. At this instant, the paper 5 closely adheres to the drum 1 due to the elasticity thereof and an electrostatic force. In this condition, the transferring device 4 transfers a toner image from the drum to the paper 5.

The image forming apparatus having the above construction has various problems left unsolved, as discussed earlier.

Referring to FIGS. 1–5, an image forming apparatus embodying the present invention is shown. In this embodiment, as well as in an alternative embodiment which will be described, the same or similar constituents as the constituents of the conventional apparatus are designated by the same reference numerals, and a detailed description thereof will not be made to avoid redundancy. As shown, the illustrative embodiment includes a transferring device 4 implemented by a contact type image transfer principle. The transferring device 4 is made up of an elastic transfer belt 18 extending substantially horizontally below a photoconductive drum 1, a drive roller 19 for driving the belt 18, a driven roller 13 tapered at opposite ends thereof for preventing the belt 18 from being displaced sideways, a bias roller 15 contacting the drum 1 over a nip width B and to which a transfer bias is applied from a high-tension power source 20, a contact plate 17 located downstream of the bias roller 15 and inside the transfer belt 18, a transfer control board 16 connected to the power source 20 and to which a current $I_2$ is fed back from the belt 18 via the contact plate 17, a lever 14 for moving the belt 18 into and out of contact with the drum 1, and a DC solenoid 24 connected to the control board 30 and lever 14 for actuating the lever 14 in response to a signal from the control board 30. A belt cleaning device 21 is associated with the transfer belt 18 and comprises a cleaning blade 31 for cleaning the surface of the belt 18 and a receptacle 23 for receiving paper dust, paper fibers and other impurities scraped off by the blade 31. A coil 22 is disposed in the cleaning device 21 for conveying the impurities from the receptacle 23 to a bottle, not shown, mounted on the apparatus body. The surface of the transfer belt 18 is coated with fluorin (vinylidene polyfluoride) to enhance the cleaning ability.

In operation, a paper 5 is fed to a registration roller 11 and stopped for a moment thereby. The registration roller 11 drives the paper 5 at a predetermined timing in synchronism with the rotation of the drum 1. When the leading edge of the paper 5 approaches the position where the drum 1 and transfer belt 18 adjoin each other, the control board 30 sends a signal to the DC solenoid 24. In response, the DC solenoid 24 raises the belt 18 into contact with the drum 1. The nip width B over which the belt 18 contacts the drum 1 is selected to be 4 mm to 8 mm. As the paper 5 enters the region defined by the nip width B, a transfer bias is applied from the high-tension power source 20 to the bias roller 15. As a result, a charge opposite in polarity to a toner deposited on the drum 1 is deposited on the belt 18 to transfer the toner from the drum 1 to the paper 5. In the event of such image transfer, the leading edge or cut edge of the paper 5 is caused to electrostatically adhere to the belt 18 before the drum 1. This allows a minimum of paper dust to be produced and prevents it from depositing on the drum 1. Further, the paper 5 remains in close contact with the belt 18 during the course of image transfer, so that paper dust, paper fibers and other impurities are not transferred from the cut edge of the paper 5 to the drum 1. Consequently, the toner removed from the surface of the drum 1 by a drum cleaning device 6 is free from impurities which would damage a cleaning blade included in the device 6 and would degrade the image quality.

Figure 4:
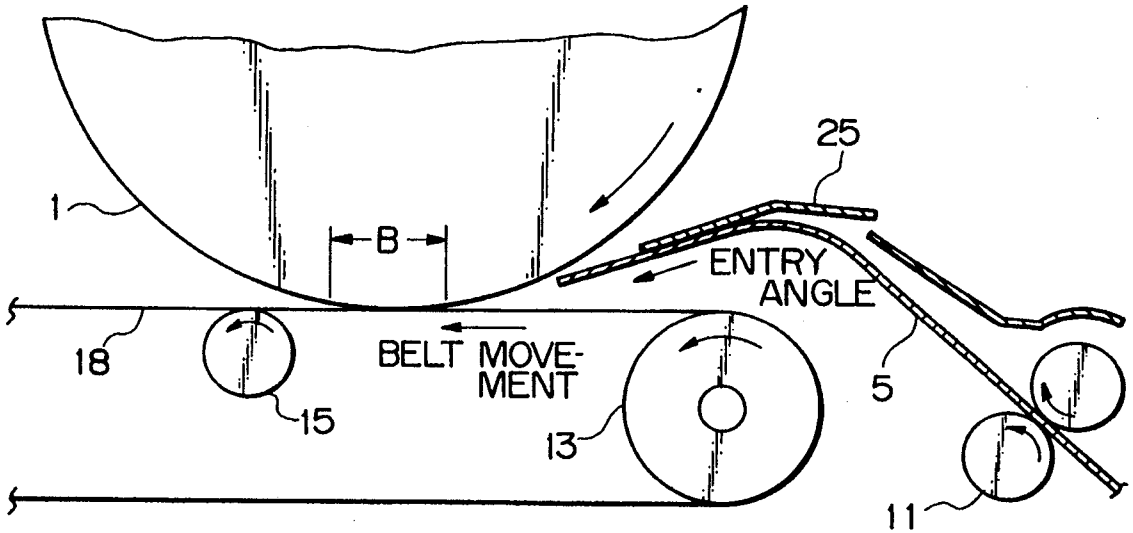
FIG. 4 is a section demonstrating how a paper is introduced in accordance with the embodiment.
Figure 5:
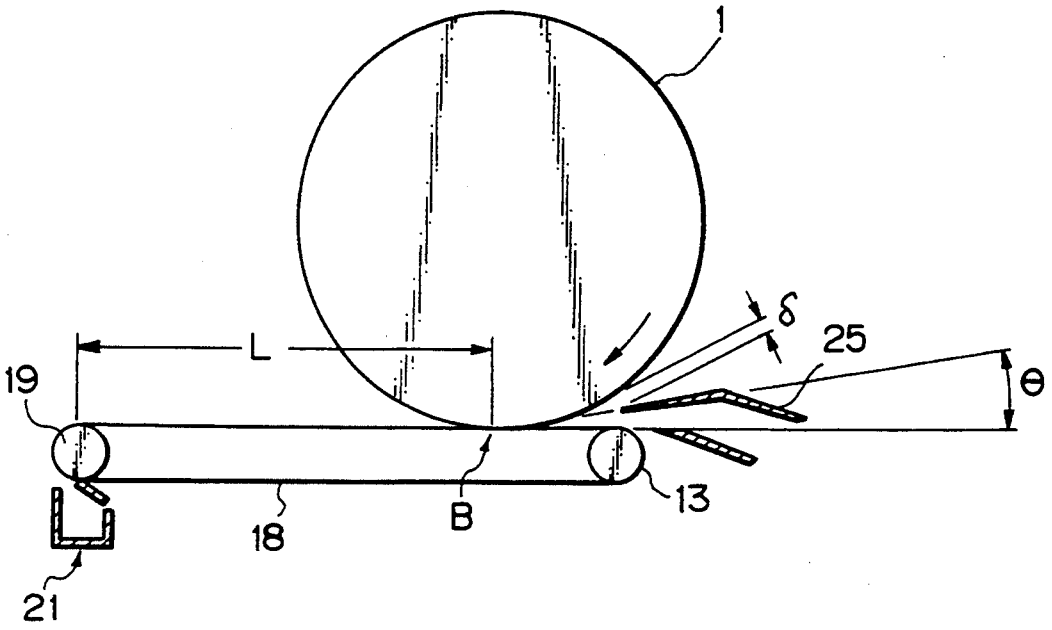
FIG. 5 shows a positional relation between the transfer belt and members adjoining it.
Figure 6:
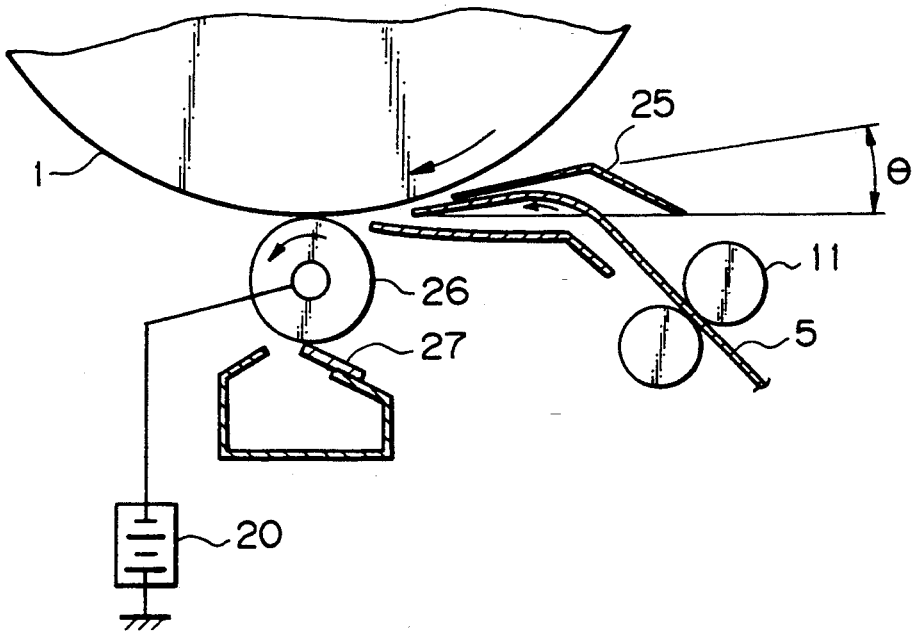
FIG. 6 is a fragmentary section showing an alternative embodiment of the present invention.

Referring again to FIG. 7, the conventional apparatus uses a corotron charger for image transfer and causes the paper 5 to closely contact the drum 1 due to the elasticity thereof. Specifically, the cut edge of the paper 5 abuts against the drum 1 from below the nip portion B of the belt 18 and drum 1 in the vertical direction. As a result, the paper 5 is bent by the drum 1 and brought into close contact with the drum 1 due to the resulting restoring force as well as by an electrostatic force. On abutting against the drum 1, the paper 5 causes paper dust and other impurities to undesirably deposit on the drum 1. By contrast, as shown in FIG. 4, the illustrative embodiment includes a guide plate 25 located upstream of the nip portion B of the drum 1 and belt 18 with respect to the direction of paper transport. The guide plate 25 guides the leading edge of the paper 5 to above the nip portion B in the vertical direction, i.e., toward the axis of the drum 1 and then guides it toward the nip portion B. In this case, with which of the drum 1 and belt 18 the leading edge of the paper 5 contacts first is not a question. This is because the paper 5 advances in the direction of movement of the surface of the drum 1 and causes the cut edge thereof to abut against the belt 18, rather than against the drum 1, while being guided along the surface of the drum 1; impurities produced electrostatically adhere to the belt 18. As shown in FIGS. 5 and 6, the paper 5 is introduced into the nip portion B at an angle $\theta$ of 5.7 degrees. As shown in FIG. 5, the leading edge of the guide plate 25 and the drum 1 are spaced apart by a gap $\delta$ ranging from 0.5 mm to 2.5 mm, preferably 1 mm. As the gap δ decreases, the paper 5 will be guided toward the drum 1 more smoothly, and therefore the impact will be reduced. However, should the gap δ be excessively small, the leading edge of the guide plate 25 might be deformed by the elasticity of the paper 5 and damage a photoconductive layer provided on the drum 1.

In the conventional corotron charger type apparatus shown in FIG. 7, the trailing edge of the paper 5 behaves as follows. If the electrostatic adhering force of the drum 1 is weak, the trailing edge of the paper 5 is apt to shake. Then, paper dust is produced from the cut edge of the paper 5 and adheres to the drum 1. As a result, the drum cleaning device 6 collects the paper dust and introduces it into the toner to be recirculated. In the illustrative embodiment, the belt 18 extends to a position downstream of the nip portion B of the drum 1 and belt 18 in the direction of paper transport, thereby conveying the paper 5 to as far as the inlet of a fixing device 12. Therefore, the position where the trailing edge of the paper 5 separates from the belt 18 is spaced far apart from the nip portion B of the drum 1 and belt 18. The belt cleaning device 21 is located in the vicinity of the drive roller 19 which drives the belt 18. In addition, as shown in FIG. 5, the distance L between the nip portion B and the axis of the drive roller 19 is selected to be 80 mm to 128 mm. In this configuration, even when the trailing edge of the paper 5 shakes on separating from the belt 18, the resulting impurities adhere to the belt 18 and are then collected by the belt cleaning device 21. As a result, such impurities are not deposited on the drum 1 or introduced into the toner to be recirculated. The impurities collected by the cleaning device 21 are not transported to the developing device 3.

Figure 2:
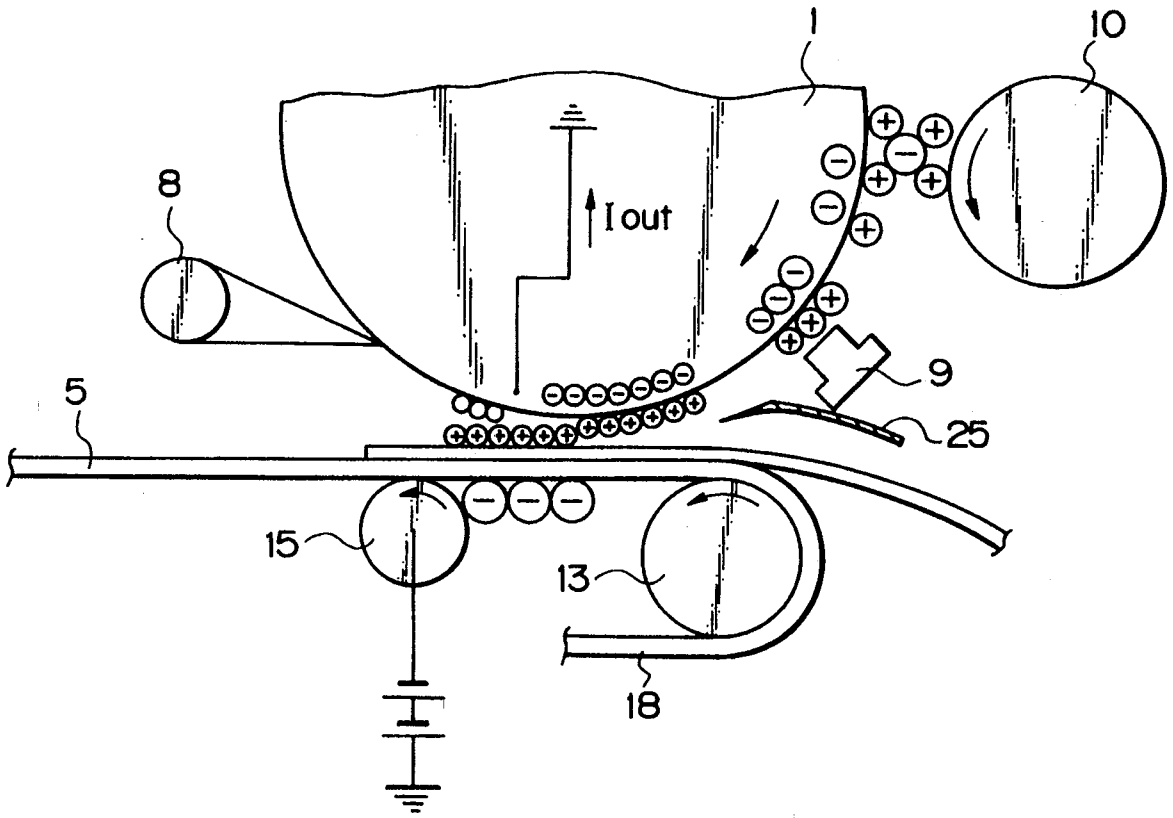
FIG. 2 is a fragmentary enlarged view of the embodiment.
Figure 3:
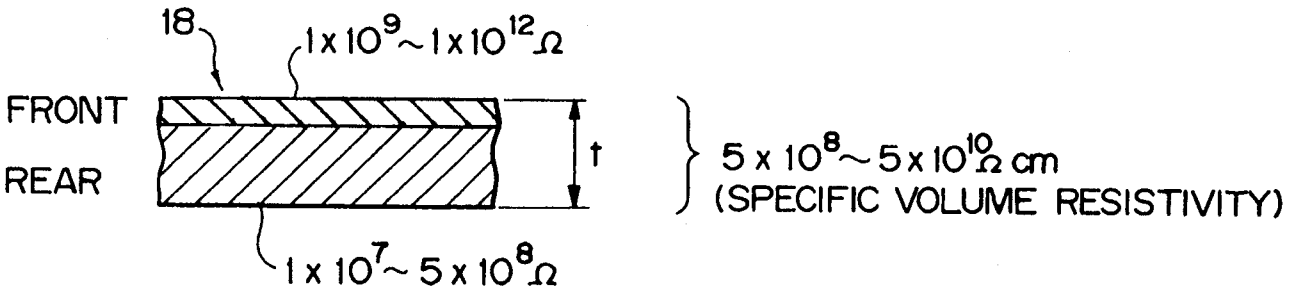
FIG. 3 is a section showing a transfer belt included in the embodiment.

Referring to FIG. 2, in this embodiment, a positively charged toner is deposited on the drum 1 which has been charged to −800 V. Subsequently, the surface potential of the drum 1 is lowered by a pretransfer discharge lamp 9, and then the toner is transferred from the drum 1 to the paper 5 by the bias roller 15 to which a bias of −1.5 kV to −2 kV is applied. At this instant, a potential of −1.3 kV to −1.8 kV is deposited on the belt 18 over the nip width B. As shown in FIG. 3, the belt 18 has an electric resistance of $1\times10^9\ \Omega$ to $1\times10^{12}\ \Omega$ on the front and an electric resistance of $1\times10^7\ \Omega$ to $5\times10^8\ \Omega$ on the rear. Hence, as the belt 18 and paper 5 move to the downstream side, the charges deposited thereon are dissipated by the contact plate 17. The bias applied to the bias roller 15 transfers the toner from the drum 1 to the paper 5 and, at the same time, charges the paper 5. As a result, an electrostatic force is generated by the true charge on the belt 18 and the polarized charge on the paper 5. This electrostatic force causes the paper 5 to adhere to the belt 18 while separating from the drum 1. This is partly because the transfer bias is higher than −1.3 kV, which is far higher than −800 V deposited on the drum 1, and partly because the paper 5 is separated from the drum 1 by curvature ascribable to the elasticity of the paper 5.

Figure 1:
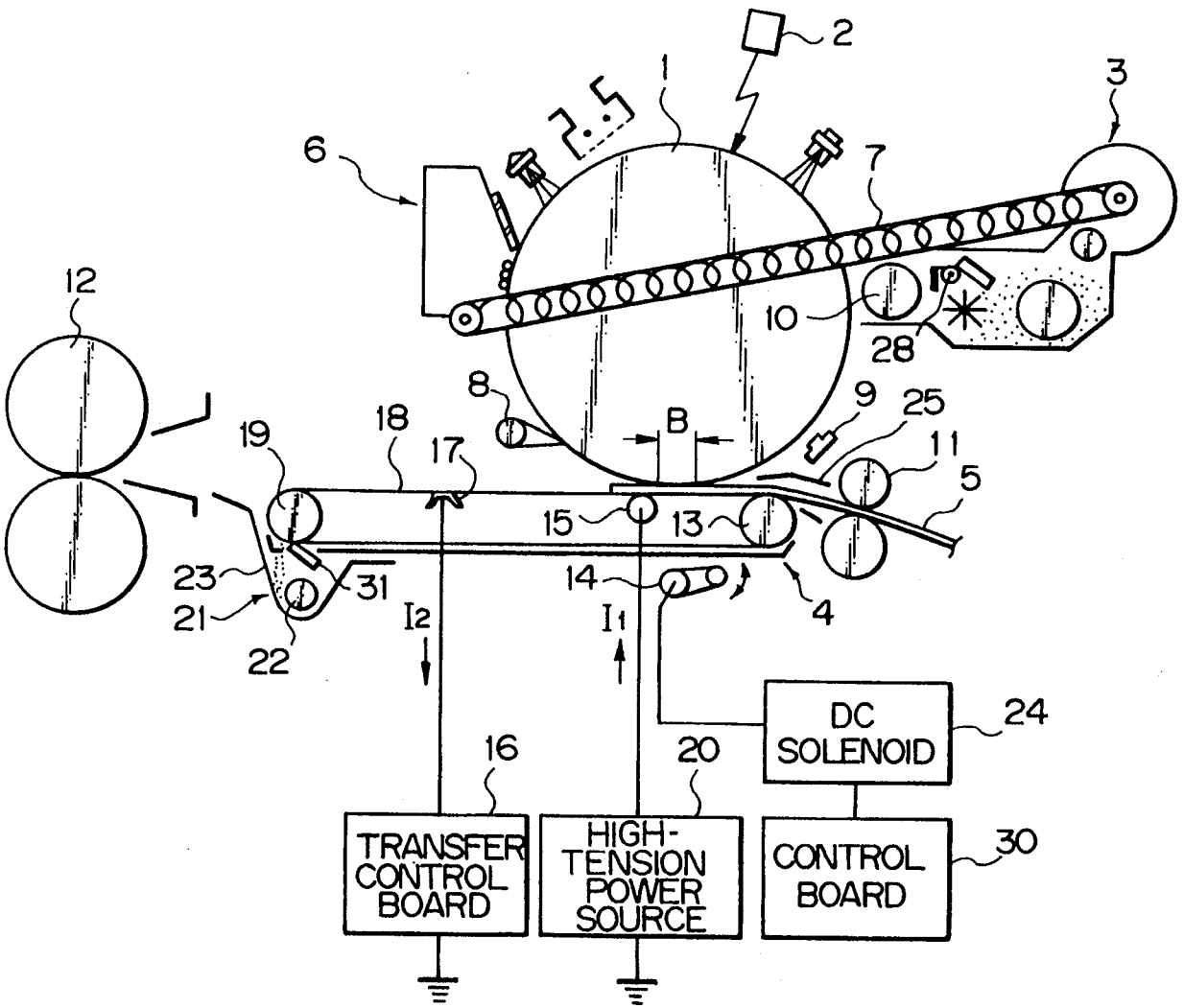
FIG. 1 is a section showing an image forming apparatus embodying the present invention.

The illustrative embodiment effects image transfer under the following condition. As shown in FIG. 1, assume that the current output from the high-tension power source 20 is $I_1$, and that a current to flow from the contact plate 17 to ground via the belt 18 is $I_2$. Then, the current $I_1$ is controlled such that $I_1-I_2=I_{out}$(=constant) holds. In the embodiment, the optimal condition is $I_{out}=35\pm5\ \mu A$. This value may be reduced when the potential of the toner is low, as in a digital system. Conversely, when the pretransfer discharge lamp 9 is absent, the above-mentioned value will increase since the potential of the drum 1 will increase. When $I_1-I_2=I_{out}$ was controlled to 35 μA to 40 μA and the resistance of the belt 18 was $2\times107\ \Omega$ to $8\times108\ \Omega$, the charge left on the drum 1 after image transfer was measured to be about 30 μC to 40 μC. In this manner, reverse charging is reduced during image transfer with the result that most of the residual toner reaches the drum cleaning device 6 while preserving the original polarity thereof. This increases the amount of reusable toner and prevents it from adversely effecting the image forming operation even when mixed with a positively charged fresh toner. With the conventional corotron charger type apparatus, the charge of the residual toner was measure to be about −20 μC/g to −30 μC/g when the transfer current was −60 μA to −70 μA; the charge deposited on the toner in the event of development was about 20 μC/g to 30 μC/g.

After the image transfer, the charge of the paper 5 is sequentially reduced by the contact plate 17 via the belt 18. On reaching the drive roller 19, the paper 5 with the electrostatic adhesion acting thereon reduced is separated from the belt 18. This entirely frees the drum 1 from impacts, noticeably reduces paper dust, and causes the belt 18 to electrostatically catch paper dust, if any. When the paper 5 is implemented as an OHP (Over-Head Projector) paper or has the resistance thereof increased in a low humidity environment, it is not easy to reduce the charge deposited thereon. In such a case, use is made of a drive roller 19 having a small diameter so as to separate the paper 5 from the drum 1 by curvature ascribable to the flexibility of the paper 5. Experiments showed that when the diameter of the drive roller 19 is 16 mm or less, even a high quality paper 45K having rigidity of 21 $cm^3/100$ in the lateral direction can be separated.

While the belt 18 is in operation, the toner scattered around without being transferred to the sheet 5, the toner directly deposited on the belt 19, and the paper dust and other impurities produced from the paper 5 exist on the belt 18. These toner and impurities are scraped off by the cleaning blade 31, collected in the receptacle 23, and then conveyed by the coil 22 to the bottle, not shown, i.e., they are not returned to the developing device 3. Hence, such a toner is prevented from depositing on the other toner or carrier to obstruct expected charging. Also, the paper dust is prevented from depositing on the inner periphery of the casing of the developing device 3 or serving as the core of toner cohesion which would lead to defective images. In this condition, the prerequisite is that the surface of the belt 18 be provided with a sufficiently low coefficient of friction μ (relative to the cleaning blade 31). Should the coefficient μ be great, the torque for driving the transferring device 4 would increase, and the cleaning blade 31 of the cleaning device 21 would be deformed.

On the other hand, the toner remaining on the drum 1 after image transfer is removed by the drum cleaning device 6 and then conveyed to a hopper included in the developing device 3 by a transporting device 7. If desired, the toner from the cleaning device 6 may be directly transported to a conveyor implemented by a screw 28.

After all the image forming steps have been completed, the DC solenoid 24 lowers the belt 18 away from the drum 1 in response to a signal from the control board 30. This frees the drum 1 from contamination which would occur if it were held in contact with the belt 18 for a long time. Particularly, when the transfer belt 18 is made of elastic rubber, oil and plastics contained therein are prevented from being transferred to the drum 1.

Referring to FIG. 6, an alternative embodiment of the present invention will be described. As shown, this embodiment uses a transfer roller 26 in place of the transfer belt 18. The guide plate 25 guides the paper at the previously mentioned angle. A cleaning blade 27 is held in contact with the surface of the transfer roller 26. Even this kind of arrangement is successful in achieving an acceptable result. The transfer roller 26 is pressed against the drum 1 by a compression spring, not shown, and rotated by the drum 1. A bias opposite in polarity to the toner (negative high voltage in the embodiment) is applied to the transfer roller 26, so that the toner is electrostatically attracted by the paper 5. The roller 26 is made of a conductive elastic material, e.g., rubber sponge or may be made of a conductive rigid material if the drum 1 is implemented as a belt. The cleaning blade 27 removes paper dust, fibers and toner scattered around from the surface of the roller 26. Preferably, the cleaning blade 27 is made of polyethyrene phthalate (MYLAR) or insulated stainless steel when the roller 26 is made of rubber sponge. When the roller 26 is made of metal, conductive resin or similar rigid material, the cleaning blade 27 should preferably be made of urethane rubber or similar elastic material.

While the embodiments described above have concentrated on a positive-to-positive electrophotographic system, the present invention is also practicable with a negative-to-positive system using digital writing, in which case both the drum 1 and the toner will be negatively charged. Specifically, a negative bias lower than the potential of the drum 1 is applied to a developing roller. A negatively charged toner is deposited on the drum 1 whose potential has been lowered by a laser beam. For image transfer, a positive charge opposite in polarity to the charge particular to the embodiments is effected to transfer the toner from the drum 1 to the paper 5.

In summary, in accordance with the present invention, an image transfer belt electrostatically collects and transports impurities produced from a paper before, after and during image transfer, thereby noticeably reducing the amount of impurities to deposit on a photoconductive element. This prevents the impurities and toner scattered around from being introduced into a developing device without resorting to an exclusive separating and removing device. Hence, even when the toner is recirculated over a long period of time, failures ascribable to the impurities do not occur, and effective developer consumption is promoted. Consequently, the present invention insures attractive images for a long time at low cost. Moreover, the structure of the present invention is simple and saves space and cost.

Various modifications will become possible for those skilled in the art after receiving the teachings of the present disclosure without departing from the scope thereof.

What is claimed is:

1. An image forming apparatus for providing impurity free toner remaining on a photoconductive element after image transfer, said apparatus comprising:

a latent image forming means for electrostatically forming a latent image on said photoconductive element;

developing means for developing said latent image to produce a corresponding toner image;

transferring means for transferring said toner image to a paper, said transferring means including an elastic transfer belt, roller means for driving said belt, a bias roller contacting said belt over a nip width and a power source for providing a high-power transfer bias to said bias roller, a contact plate located downstream of said bias roller wherein said power source provides a first current and said contact plate provides a second current wherein the difference between said first current and said second current is a predetermined value resulting in a reduction in the reverse charging during image transfer so that residual toner retains an original polarity, said transferring means also including a paper guide means and a belt cleaning means for removing impurities.

2. An apparatus as claimed in claim 1, wherein said transfer belt extends to a position downstream of a nip portion of said transfer belt and said photoconductive element with respect to an intended direction of paper transport.

3. An apparatus as claimed in claim 1, wherein a surface of said transfer belt of said transferring means is provided with a sufficiently low coefficient of friction.

* * * * *